US006256936B1

(12) United States Patent
Swensson et al.

(10) Patent No.: US 6,256,936 B1
(45) Date of Patent: Jul. 10, 2001

(54) VANITY STATION AND NURSE'S STATION

(75) Inventors: Earl S. Swensson, Franklin; David S. Gilbert, Hermitage; George P. McAllister, Jr., Franklin; Joseph L. Miles, Jr., White Bluff, all of TN (US)

(73) Assignee: Wellness, LLC, Nashville, TN (US)

( * ) Notice: Subject to any disclaimer, the term of this patent is extended or adjusted under 35 U.S.C. 154(b) by 0 days.

(21) Appl. No.: 09/266,571

(22) Filed: Mar. 11, 1999

(51) Int. Cl.[7] ..... A47K 4/00

(52) U.S. Cl. ..... 52/35; 52/36.2; 52/79.1; 312/140.1; 4/614; 4/630; 4/663

(58) Field of Search ..... 52/34, 35, 36.1, 52/36.2, 36.4, 79.1; 433/77; 312/108, 195, 223.3, 140.1; 4/663, 662, 553, 549, 635, 614, 670, 630–632

(56) References Cited

U.S. PATENT DOCUMENTS

| | | | | |
|---|---|---|---|---|
| 2,396,992 | * | 3/1946 | Evans | 4/663 |
| 2,419,319 | | 4/1947 | Lankton | 20/2 |
| 3,015,110 | * | 1/1962 | Treand | 4/663 |
| 3,047,106 | | 7/1962 | Callahan | 189/1 |
| 3,455,620 | | 7/1969 | Coburn | 312/209 |
| 3,458,871 | | 8/1969 | Valcervo | 4/3 |
| 3,492,767 | | 2/1970 | Pincus | 52/79 |
| 3,531,898 | | 10/1970 | Facemire | 52/6 |
| 3,533,200 | * | 10/1970 | Zoebelein | 52/35 |
| 3,567,842 | | 3/1971 | Meyer | 174/48 |
| 3,585,767 | | 6/1971 | Torsten et al. | 52/79 |
| 3,623,284 | | 11/1971 | Meyer | 52/34 |
| 3,742,932 | | 7/1973 | Greenspan | 128/1 R |
| 3,775,919 | | 12/1973 | Fulton et al. | 52/236 |
| 3,827,086 | * | 8/1974 | Seymour et al. | 4/614 |
| 3,953,093 | | 4/1976 | Hero | 312/245 |
| 4,116,509 | | 9/1978 | Smith | 312/259 R |
| 4,130,123 | | 12/1978 | Wines, Jr. et al. | 134/56 R |
| 4,171,545 | | 10/1979 | Kann | 4/1 |
| 4,171,596 | | 10/1979 | Varlonga | 52/79.5 |
| 4,181,347 | | 1/1980 | Clark | 296/1 R |
| 4,221,441 | | 9/1980 | Bain | 312/228 |
| 4,228,623 | | 10/1980 | Menosso | 52/79.3 |
| 4,295,678 | * | 10/1981 | Morris | 52/35 X |
| 4,332,557 | * | 6/1982 | Watanabe | 52/35 X |
| 4,357,721 | * | 11/1982 | Newburger | 4/549 X |
| 4,475,322 | | 10/1984 | Russo et al. | 52/27 |
| 4,485,598 | | 12/1984 | Guardiani | 52/79.1 |
| 4,644,705 | | 2/1987 | Saccomani et al. | 52/27 |
| 4,667,580 | | 5/1987 | Wetzel | 98/34.6 |
| 4,840,000 | | 6/1989 | Grines | 52/36 |
| 4,862,527 | | 9/1989 | McAllister | 4/612 |
| 5,107,636 | | 4/1992 | Schindele et al. | 52/27 |
| 5,111,626 | * | 5/1992 | Fortune | 52/34 |
| 5,592,787 | | 1/1997 | Ophardt | 52/34 |
| 5,640,816 | | 6/1997 | Reiland et al. | 52/239 |
| 5,643,488 | | 7/1997 | Lee | 249/34 |
| 5,652,976 | | 8/1997 | Hopper | 4/664 |
| 5,727,353 | | 3/1998 | Getz et al. | 52/79.1 |
| 5,782,045 | | 7/1998 | Paschal | 52/220.8 |

FOREIGN PATENT DOCUMENTS

| | | | | |
|---|---|---|---|---|
| 4-4135965 | * | 5/1992 | (JP) | 52/34 |
| 4-179779 | * | 6/1992 | (JP) | 52/34 |

* cited by examiner

*Primary Examiner*—Carl D. Friedman
*Assistant Examiner*—Winnie Yip
(74) *Attorney, Agent, or Firm*—Waddey & Patterson

(57) ABSTRACT

A pre-fabricated module includes a counter-top having a front access edge, side portions and a rear portion. A sink is disposed in the counter-top. A perimeter wall extends upward from the side and rear portions of the counter-top. A ceiling spans the perimeter wall above the counter-top. The module is preferably constructed as a one piece integrally molded structure.

9 Claims, 15 Drawing Sheets

VANITY STATION AND NURSE'S STATION

BACKGROUND OF THE INVENTION

1. Field of The Invention

The present invention relates generally to pre-fabricated vanity unit and nurse's station modules, and more particularly, but not by way of limitation, to modules which are particularly adapted for use in a patient healthcare room.

2. Description of the Prior Art

The present state of the art in the construction of hospital rooms and other healthcare facilities utilizes on site stick built construction of the room interior. Interior furnishings are selected from various conventional sources and may or may not optimize the usefulness and attractiveness of the completed room.

In addition to the non-optimal design, such traditional methods of construction involve long and unreliable construction times due to the difficulties in scheduling the various craftsmen such as carpenters, painters, plumbers, electricians and the like to complete the construction work.

The same problems are encountered in both new construction and in renovation using traditional methods.

Furthermore, in today's more competitive healthcare environment there is a demand by patients for more livable and pleasant accommodations, as contrasted to the typical sterile clinical environment of traditional hospital room construction.

Accordingly there is a need for an optimal healthcare room interior design which at the same time can be rapidly installed either in a new construction or renovation situation.

Particularly, there is a need in such a healthcare room interior for prefabricated components such as a pre-fabricated vanity unit which is economically constructed and assembled with the other components of the room.

SUMMARY OF THE INVENTION

A pre-fabricated vanity unit module includes a countertop having a front access edge, side portions and a rear portion. A sink is disposed in the countertop. A perimeter wall extends upward from the side and rear portions of the countertop. A ceiling spans the perimeter wall above the countertop.

In another aspect of the present invention the vanity station includes a countertop having a front access edge, side portions and a rear portion. A sink is disposed in the countertop. A perimeter wall extends upward from the side and rear portions of the countertop. The perimeter wall includes two planar side portions and a planar backwall portion. The sidewall portions are slanted toward each other in plan view so that the sidewall portions are closer together adjacent the backwall portion than they are adjacent the front access edge. The sidewall portions and the backwall portions intersect to form two obtuse corners.

In yet another aspect of the present invention a molded unit includes a countertop having a front access edge, side portions and a rear portion. A sink is disposed in the countertop. A perimeter wall extends upward from the side and rear portions of the countertop. The countertop, the sink and the perimeter wall are formed as a one piece integrally molded structure.

Numerous other objects features and advantages of the present invention will be readily apparent to those skilled in the art upon the reading of the following disclosure when taken in conjunction with the accompanying drawings.

DETAILED DESCRIPTION OF THE PREFERRED EMBODIMENTS

Figure 1:
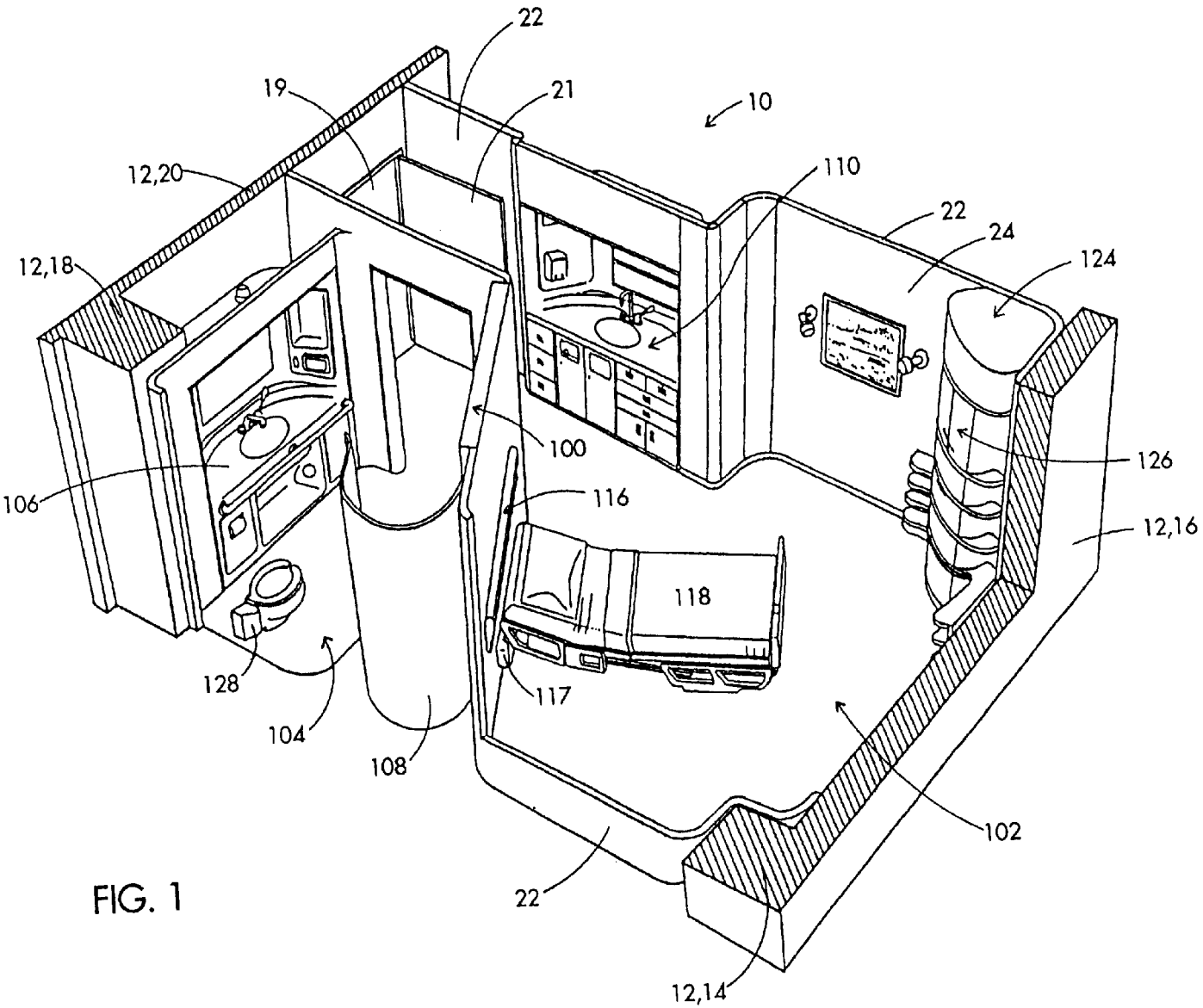
FIG. 1 is a perspective cutaway view of a first embodiment of the modular room interior of the present invention.
Figure 3:
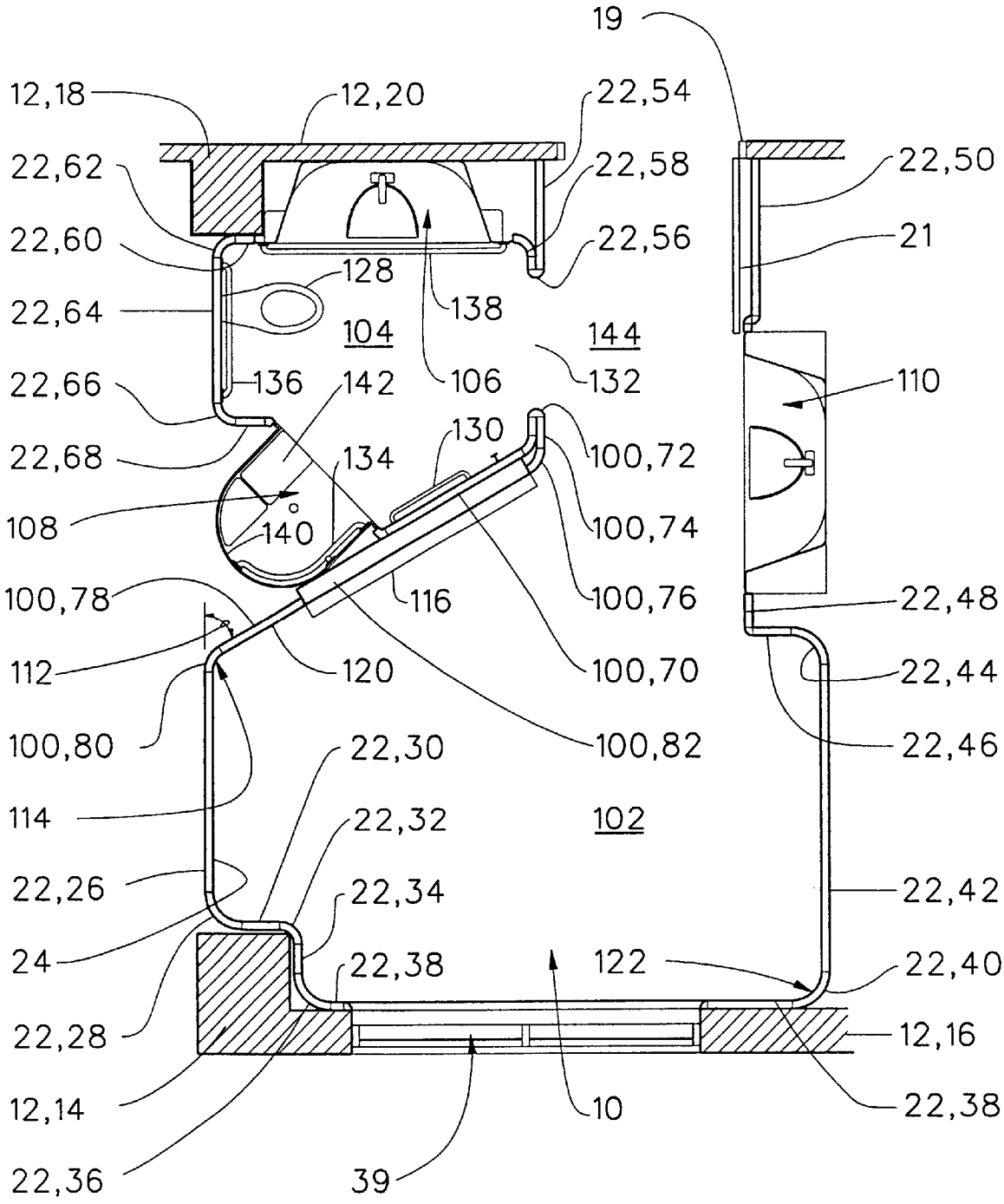
FIG. 3 is a plan view of the room interior of FIG. 1.

Referring now to the drawings, and particularly to FIGS. 1 and 3, a modular patient healthcare room interior assembly is shown and generally designated by the numeral 10.

The interior assembly 10 is installed in an unfinished space of a building 12. The building 12 typically includes exterior columns 14, exterior walls 16, interior columns 18, and interior walls 20. In the embodiment shown in FIG. 1, the interior wall 20 may also be referred to as a hallway wall 20.

It will be appreciated that there are many varieties of building construction and that the particular type and arrangement of the various structural members defining the building super structure are not critical to the present invention.

The modular room interior assembly 10 of the present invention may be modified as necessary to fit within any existing or planned building construction.

The interior building wall 20 includes a doorway opening 19 and door 21.

The major components of the room interior 10 include a modular sidewall assembly 22, a divider wall assembly 100, which in part separates the room into a bedroom 102 and bathroom 104, a pre-fabricated vanity unit 106, a pre-fabricated bathing unit 108, and a pre-fabricated nurse's station 110.

All of the interior walls of the room 10 are defined by the modular sidewall assembly 22 which is made up of a plurality of pre-fabricated wall panel segments connected together at the onsite location. Each of the wall segments includes a finished interior wall surface 24. Preferably the interior wall surface 24 is covered with a washable vinyl material, but any other desired wall finish including paint could be used. All of the wall segments are, however, fabricated in an off site facility where they are completely finished, and thus are ready to be assembled on site into a finished room interior. There is no need for painting or papering the room interior walls after the panels are assembled.

Beginning on the left hand side of FIG. 3, the modular sidewall assembly 22 includes a relatively long linear panel 26, a concave rounded interior segment 28, a short linear segment 30, a convex rounded interior panel 32, a short linear panel 34, a concave rounded interior panel 36, a linear panel 38, fitted around a window opening 39, a concave rounded corner panel 40, another longer linear panel 42, another concave rounded corner panel 44, two short linear panels 46 and 48 which lead up to the nurse's station 110. On the other side of the nurse's station 110 there is another linear panel 50, which leads to the hallway door opening 19 in the interior building wall 20.

The modular sidewall assembly 22 continues on the opposite side of the hallway door opening 19 with another linear panel 54, a bathroom entry trim piece 56, and a concave rounded corner panel 58 which leads to the vanity unit 106. On the other side of the vanity unit 106, the sidewall assembly 22 continues with a short linear panel 60, a concave rounded corner panel 62, a longer linear panel 64, another concave rounded corner panel 66, and a short linear panel 68 which leads to the bathing unit 108.

On the opposite side of the bathing unit 108, is found the divider wall 100. The divider wall 100 includes a linear panel 70, doorway opening trim panel 72, a short linear panel 74, a rounded corner panel 76, and a long linear panel 78 which is joined by a concave corner panel 80 to the linear panel 26 of sidewall assembly 22.

Although some of the components of the divider wall 100 are constructed from the same types of panel segments as the segments of wall assembly 22, the divider wall 100 also includes a special wall section known as a headwall panel 82. The headwall panel 82 may be constructed in a manner similar to that of the wall panel segments, but is typically thicker and of more sturdy construction. The headwall panel 82 is constructed to have a medical gas rail assembly 116 and a bed locator 117 (see FIG. 1) mounted thereon. The headwall unit 82 will also carry various plumbing and electrical connections for the medical gas rail assembly 116 and bed locator 117.

Figure 18:
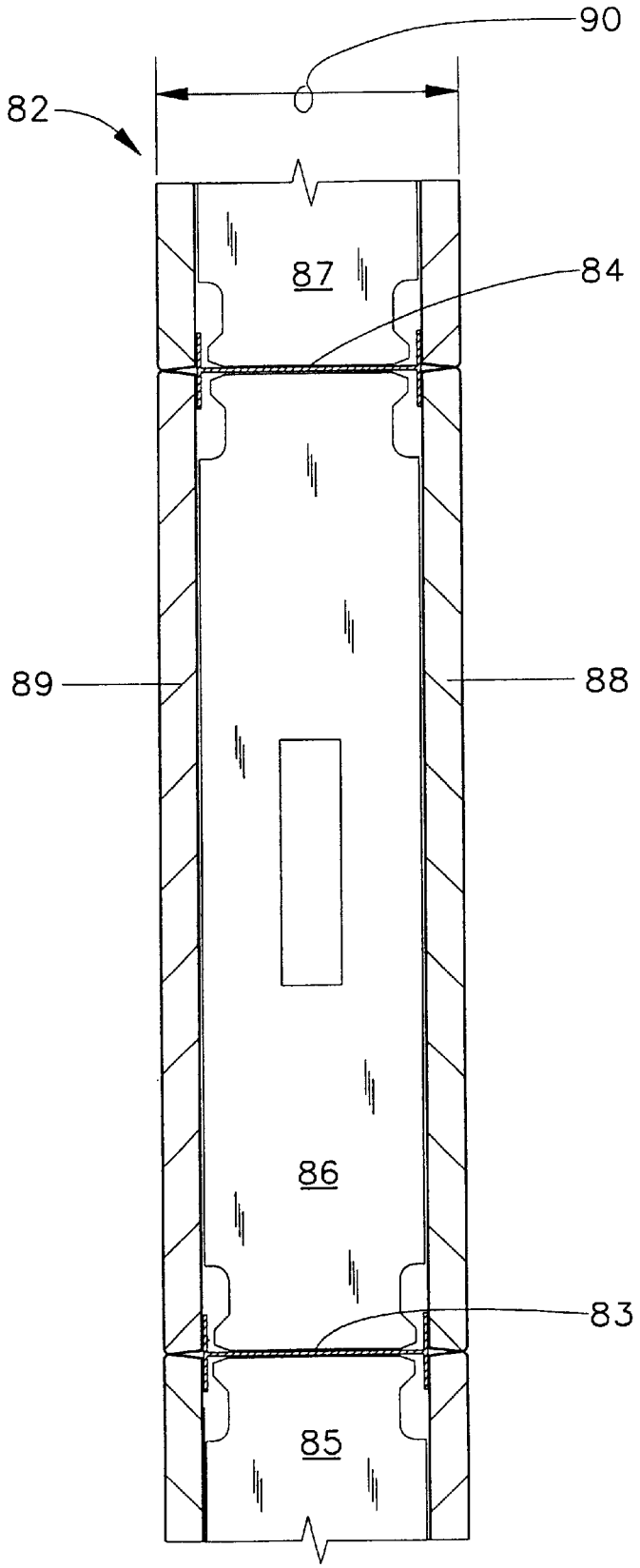
FIG. 18 is a downward looking cross-sectional view showing interior construction of the headwall/divider wall to which the medical gas rail assembly is mounted.

FIG. 18 illustrates further details of the construction of the interior of the headwall panel 82. Headwall panel 82 is made up of an internal structure including vertical metal I-beams or studs such as 83 and 84, and cross-bridging such as 85, 86 and 87 which spans between adjacent vertical I-beams. The cross-bridging snaps in place between the I-beams. First and second outer wall panels such as 88 and 89 snap into place on the internal structure.

The wall panels 88 and 89 may be ⅝ inch thick gypsum board covered with a washable vinyl outer covering. The thickness 90 of headwall 82 can vary, but typically is five inches.

It is noted that the divider wall 100 may be described as at least partially dividing the room space into the bedroom 102 and the bathroom 104. One could also describe the divider wall 100 and certain portions of the sidewall such as sidewall panel segment 54 as collectively defining an enclosure wall around the bathroom 104.

It will be appreciated that the various panel segments which make up the sidewall assembly 22 and divider wall 100 will be for most part made up of standard dimension components, but for any particular room it will likely be necessary for a few custom components to be designed to accommodate the unique shapes and arrangements of the existing structural columns and walls of the building super structure.

Figure 11:
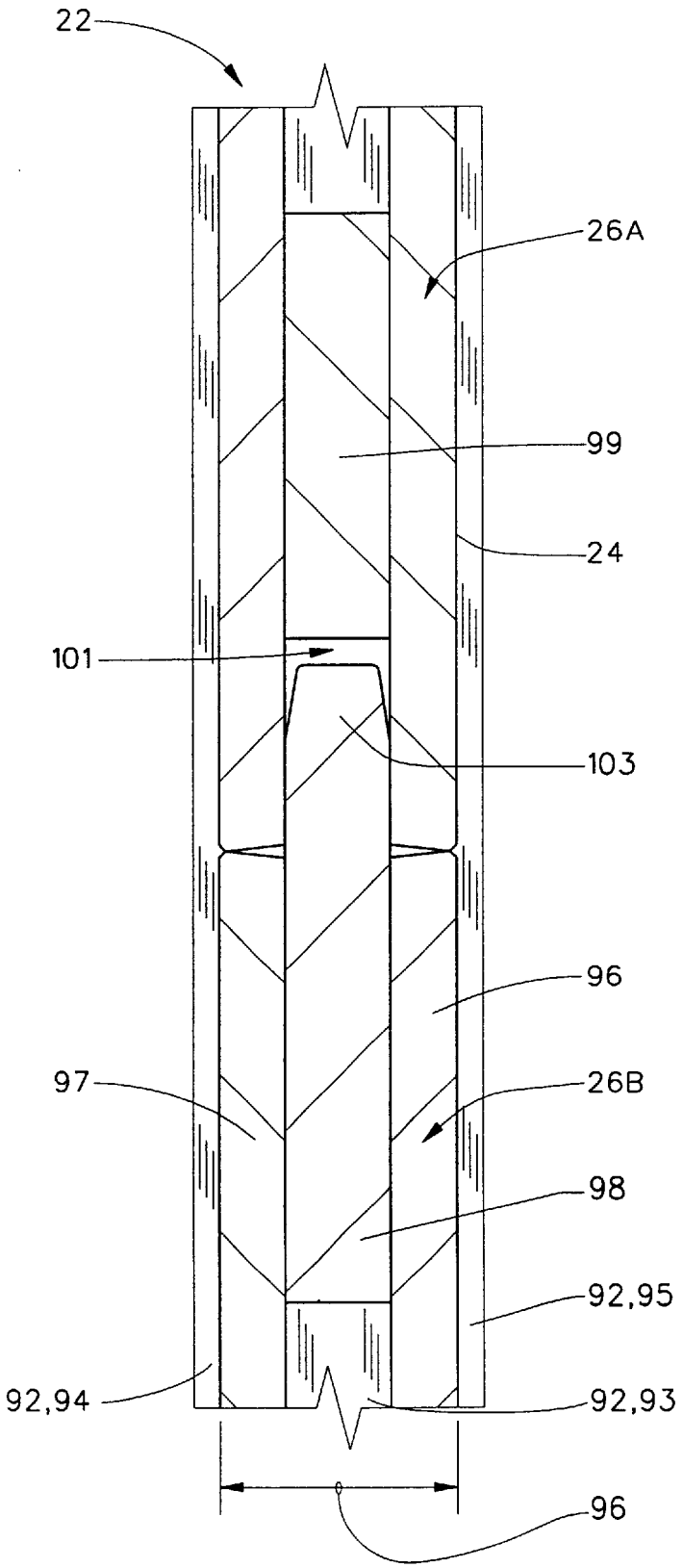
FIG. 11 is a downward looking cross-sectional view showing two of the sidewall panel segments fitted together, and received in a floor channel.

FIG. 11 shows a typical construction for one of the sidewall panels with connecting means for connecting the panel to adjacent panels of either the sidewall assembly 22 or divider wall 100.

For example, in FIG. 11 two adjacent standard two foot wide segments 26A and 26B of linear panel 26 are shown. The panel segments are received in channel shaped floor and ceiling tracks. The floor track 92 has a web 93 and upward extending flanges 94 and 95. The ceiling track is similar but inverted.

The panel segments 26A and 26B have a width 96, typically of 3¼ inches, which is closely received between flanges 94 and 95.

Each wall panel segment such as 26B includes an interior panel board 96 and an exterior panel board 97. Interior panel board 96 has the interior surface 24 covered with a washable vinyl covering. Boards 96 and 97 are separated by a tongue spacer 98 and central spacers such as 99. Central spacer 99 of panel segment 26A is spaced inward to form a groove 101 in which a tongue 103 of panel segment 26B is slidably received.

The boards 96 and 97 and the spacers 98 and 99 may all be constructed of ⅝ thick gypsum board.

Thus the segments are easily assembled on site by sliding them into the floor and ceiling channels, and sliding the panel segments into a tongue and groove engagement with each other.

The divider wall 100 extends from the sidewall assembly 22 so that an acute angle interior corner 112 is defined in the bathroom 104 adjacent divider wall 100, and so that an obtuse angle interior corner 114 is defined in the bedroom 102 adjacent the divider wall 100.

A medical gas rail assembly 116 is mounted on the headwall panel 82 of the divider wall assembly 100. It is possible to alternatively locate the headwall panel and the medical gas rail assembly on the sidewall, as seen in the third room from the left in FIG. 16. The assembly 116 includes a plurality of healthcare utility connections such as electrical power (standard and emergency), air, oxygen, vacuum, communications, lighting controls and the like. The headwall bed locator unit 116 may be an Integris 2001 Headwall System including rail and locator module, manufactured by the Hill-Rom Company.

Located on headwall panel 82 below the medical gas rail assembly 116 is a bed locator 117 (See FIG. 1) which locates the hospital bed 118 and carries electrical connections and the like for the bed.

The divider wall 100 includes a bedroom side 120 which faces toward a diagonally opposite corner 122 of the bedroom 102. As seen in FIG. 1, a corner armoire 124 is located in the corner 122. The armoire 124 includes a space for a television receiver 126 which is thus conveniently located to be viewed by the patient lying in the bed 118.

In the embodiment of FIGS. 1 and 3, the bathing unit 108 is preferably a shower stall 108. The shower stall 108 is located in the acute angled corner 116 adjacent the divider wall 100.

In the embodiment of FIGS. 1 and 3, the vanity unit 106 is located on a side of the bathroom 104 opposite from the divider wall 100. A toilet 128 is located in the bathroom 104 adjacent the wall section 64 of sidewall 22.

The bathroom 104 is provided with hand rails throughout in order to assist disabled patients. A first hand rail 130 is located to the left upon entering through the doorway 132 to the bathroom 104. A second hand rail 134 is located within the shower stall 108. A third hand rail 136 is located adjacent the toilet 128. A fourth hand rail 138 is attached to the vanity unit 106.

It is noted that doorway 132 will typically be closed by either a conventional hinged door or a sliding door.

The shower stall 108 has rounded interior walls 140 which provide superior support to a disabled patient who may be leaning against the wall. Also provided is a folding bench 142 so that patients may sit in the shower.

The bedroom 102 includes an area adjacent the hallway door opening 19 which functions as a staff foyer 144. The bathroom 104 opens through opening 132 into the staff foyer 144. The nurse's station 110 faces into the staff foyer 144 on a side of the staff foyer 144 opposite the bathroom opening 132.

As noted, all of the corners of the room are defined either by the rounded concave corner panel section such as 28 or the rounded convex panel portion such as 32. This provides many advantages. It eliminates the danger of sharp corners to patients who may fall in the room. Also it provides a very pleasing appearance and is easier to clean. The rounded convex wall panels such as 32 preferably have a radius of curvature of at least four inches and typically 7¼ inches. The concave corner portions 28 preferably have a radius of curvature of at least four inches and typically 7¼ inches. The radiused corners in bathroom 104 have a radius of curvature typically of four inches.

Figure 2:
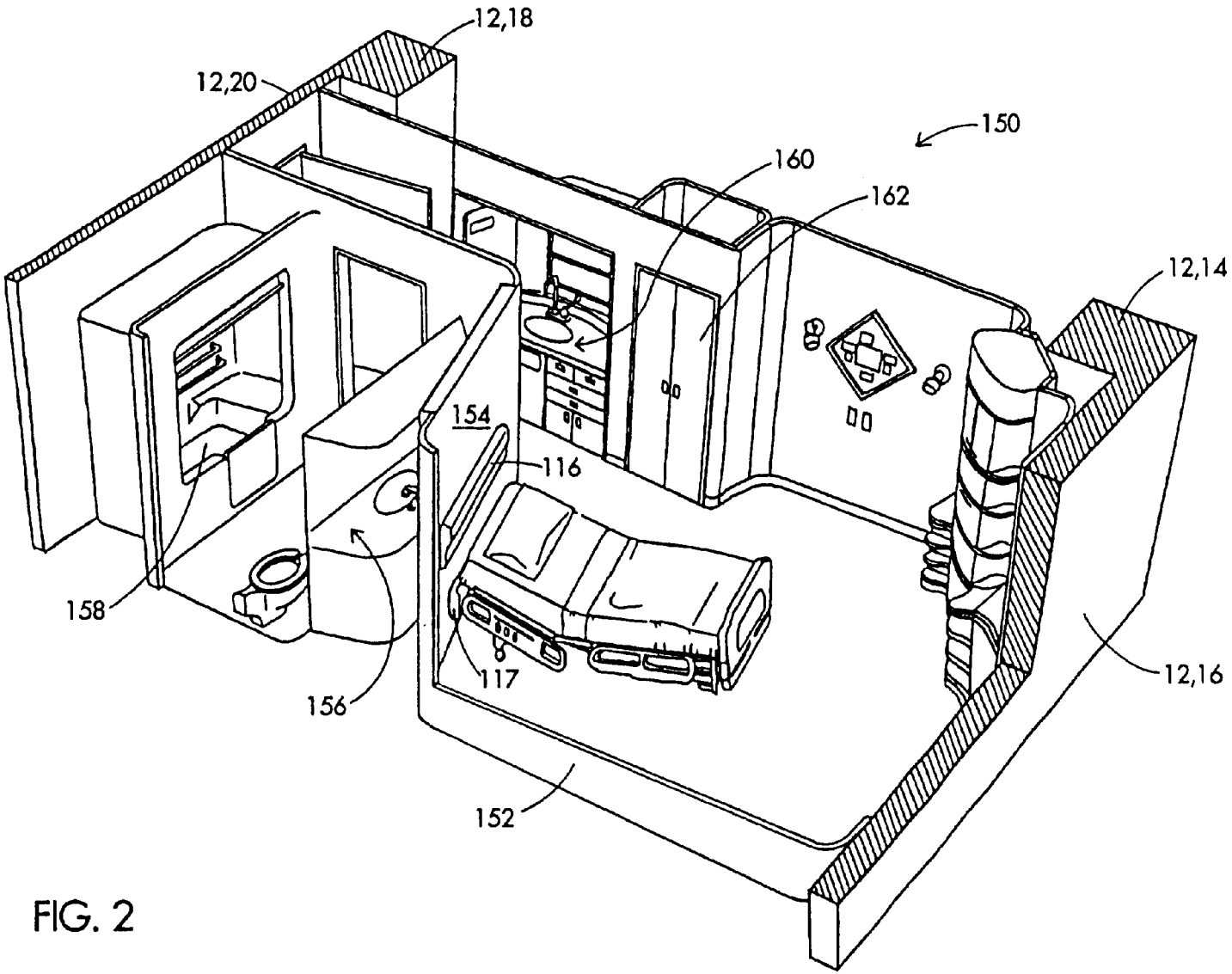
FIG. 2 is a perspective cutaway view of a second embodiment of the modular room interior.
Figure 4:
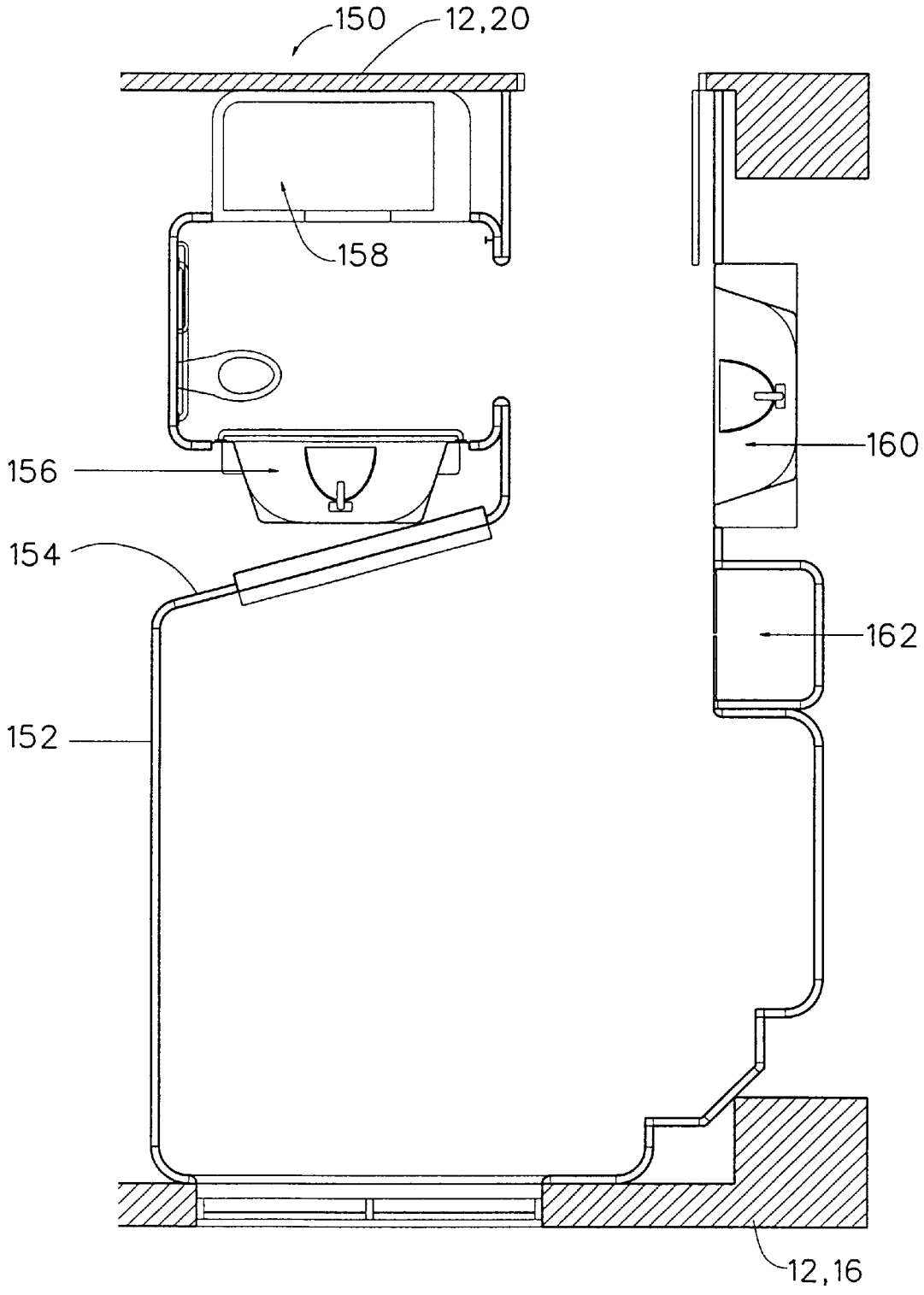
FIG. 4 is a plan view of the room interior of FIG. 2.

The Embodiment of FIGS. 2 and 4

Looking at FIGS. 2 and 4, a second embodiment of the present invention is shown. The room interior assembly of FIGS. 2 and 4 is generally designated by the numeral 150. The room interior 150 includes a modular sidewall assembly 152, a divider wall 154, a vanity unit 156, a bathing unit 158 and a nurse's station 160.

In the embodiment of FIGS. 2 and 4, the bathing unit 158 includes a tub located on a side of the bathroom opposite from the divider wall 154. The vanity unit 156 is located in the bathroom adjacent the divider wall 154.

The medical gas rail assembly 116 may be a Provider 6000 Bed Locator Module and Medical Gas Rail Assembly manufactured by Modular Services Company of Oklahoma City.

The room of FIGS. 2 and 4 is somewhat larger than the room of FIGS. 1 and 3, thus providing a larger bathroom which has room for the tub unit 158 and also providing a larger bedroom which provides more room for furnishings as shown, and which provides space for a closet 162.

The Vanity Unit and The Nurse's Station

Figure 5:
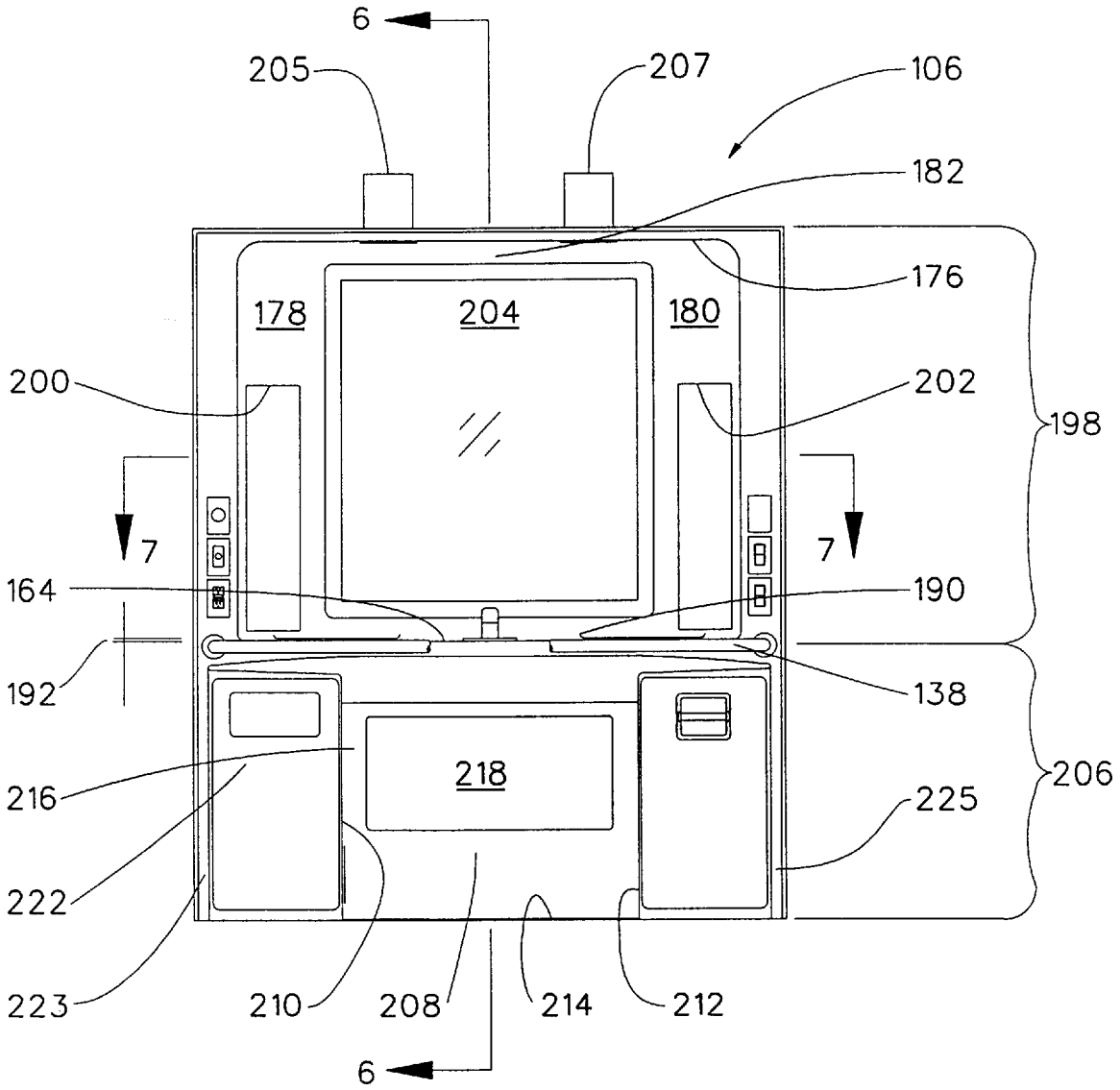
FIG. 5 is a front elevation view of the pre-fabricated vanity unit.
Figure 6:
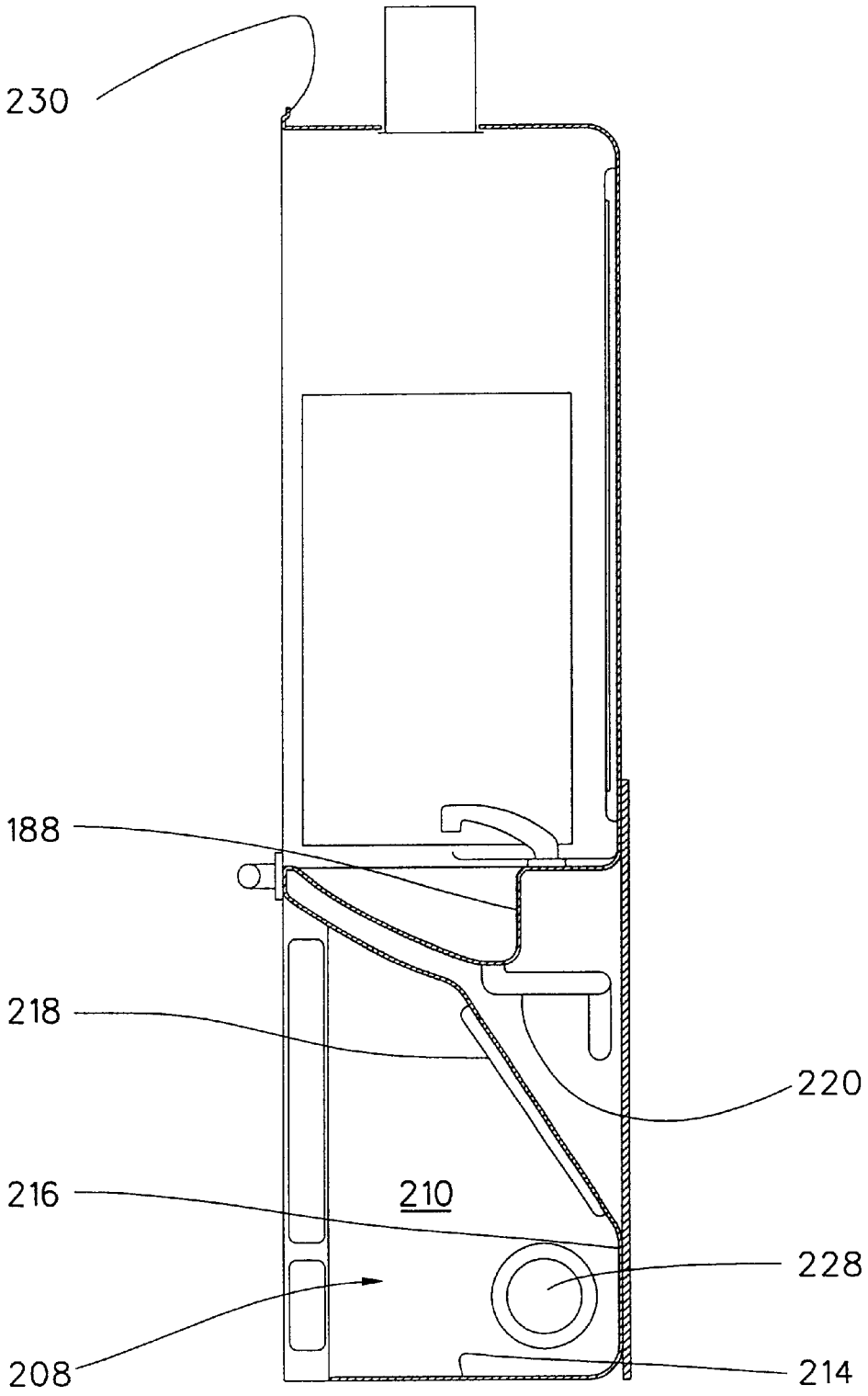
FIG. 6 is a sectioned elevation view taken along line 6—6 of FIG. 5.
Figure 7:
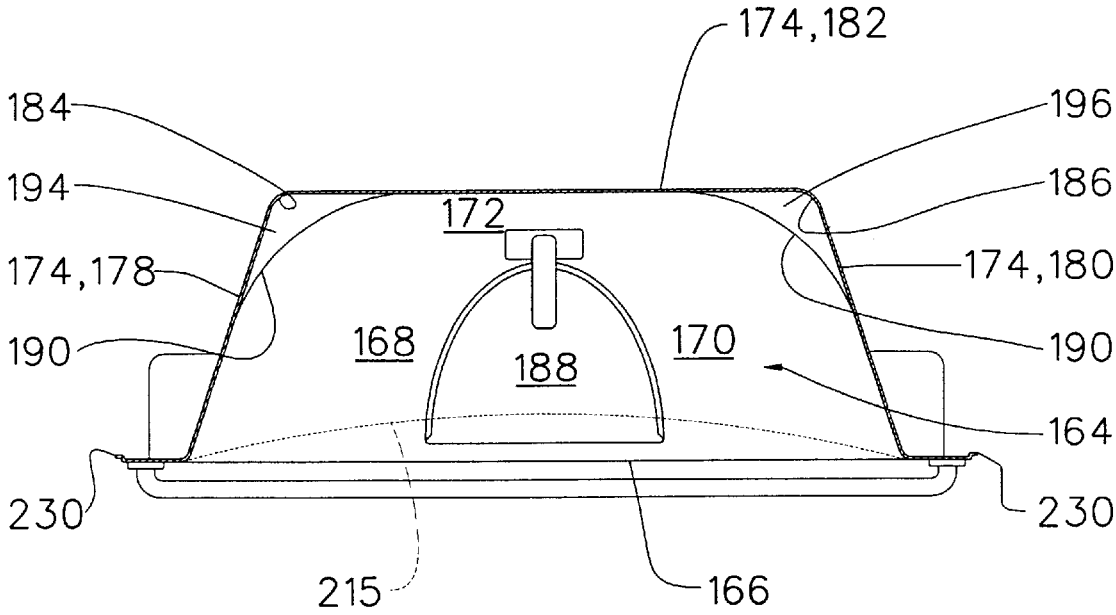
FIG. 7 is a section plan view taken along FIG. 7—7 of FIG. 5.

The details of construction of the vanity unit are shown in FIGS. 5–7. The details of construction of the vanity unit 106 of FIGS. 1 and 3 and those of the vanity unit 156 of FIGS. 2 and 4 are identical.

Vanity unit 106 is a pre-fabricated module. It includes a countertop 164 having a front access edge 166, side portions 168 and 170 and a rear portion 172. A back wall or perimeter wall 174 extends upward from the side and rear portions of the countertop 164. A module ceiling 176 spans the perimeter wall 172 above the countertop 164.

The perimeter wall 174 includes two planar sidewall portions 178 and 180 and a backwall portion 182. As best seen in FIG. 7, the sidewall portions 178 and 180 are slanted toward each in plan view so that the sidewall portions are closer together adjacent the backwall portion 182 than they are adjacent the front access edge 166. The sidewall portions 178 and 180 intersect the backwall portion 182 to form two rounded obtuse interior corners 184 and 186.

The front access edge 166 of the countertop 164 is straight, and in plan view as seen in FIG. 7 the front access edge 166 and the perimeter wall 174 form a generally trapezoidal shape.

A sink 188 is located centrally in the countertop 164. In the preferred embodiment the sink 188 is integrally molded with the countertop 164 as further described below. Conventional faucets are mounted adjacent the sink 188.

The countertop 164 has an arcuate enclosed edge 190 bounded by and tangential to the sidewall portions 178 and 180 and backwall portion 182 of the perimeter wall 174. The arcuate edge 190 is located above the elevation of countertop 164 by a distance 192 so as to form first and second integral shelves 194 and 196 lying outside the arcuate edge 190 and above the elevation of the countertop 164.

The countertop 164, sink 188, perimeter wall 174, ceiling 176 and the integral shelves 194 and 196 are preferably formed as a one piece integrally molded structure which is molded from a plastic material such as acrylic for example.

The countertop 164, perimeter wall 174 and ceiling 176 may be collectively generally described as an upper portion 198 of the module 106.

Although the side panels 178 and 180 are molded as a continuous solid member, they will typically have openings such as 200 and 202 cut therein for receiving pre-fabricated cabinet structures.

Figure 12:
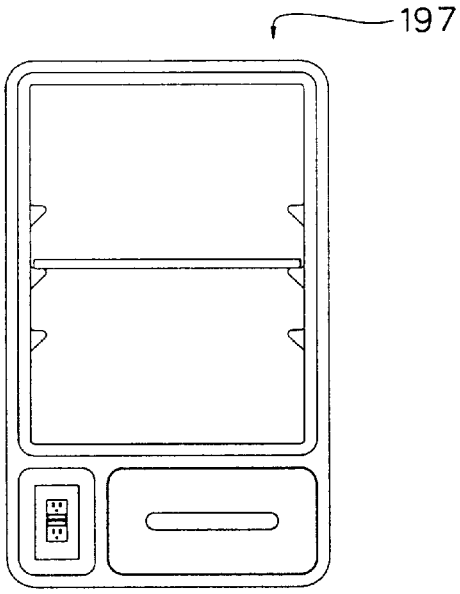
FIG. 12 is a front elevation view of a vanity storage cabinet module.
Figure 13:
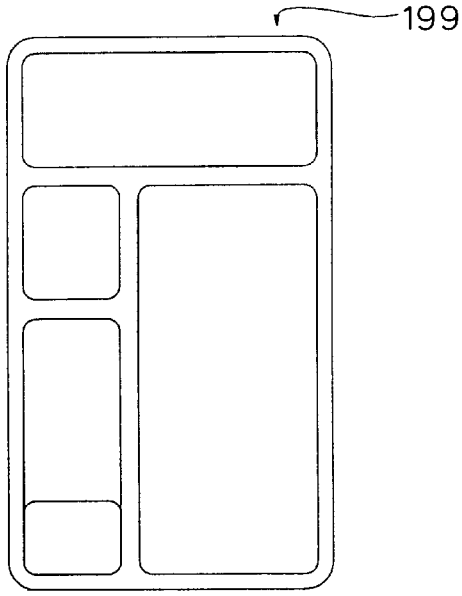
FIG. 13 is a front elevation view of a towel and soap dispenser cabinet module.

The first cabinet receiving opening 200 preferably receives an open front vanity storage cabinet 197 as shown in elevation view in FIG. 12. The second cabinet receiving opening 200 preferably receives a towel and soap dispensing cabinet 199 as shown in FIG. 13. The positions of cabinets 197 and 199 may be reversed.

A mirror 204 is mounted on the back wall 182. A pair of can type lighting fixtures 205 and 207 are mounted in the module ceiling.

The module 106 also includes a lower portion 206 which is preferably integrally molded with the upper portion 198.

The lower portion 206 is located below countertop 164 and has a concave wheelchair receiving recess 208 defined therein immediately below the sink 188. The concave recess 208 is defined by interior sidewalls 210 and 212, a floor 214 and a pipe shield wall 216. The pipe shield wall 216 includes a removable access panel 218 for allowing access to plumbing 220 connected to the sink 188. The lower portion 206 includes left and right forward facing front side panels 223 and 225 on either side of the wheelchair receiving recess 208.

Preferably, the floor panel 214 has a portion thereof cut out from the front edge thereof to an arcuate line 215 the location of which is best shown in FIG. 7. The cutout along arcuate line 215 is for the purpose of improving wheelchair access by eliminating the need for a wheelchair to roll over a front lip of the floor panel 214.

The sidewalls 210 and 212, floor 214 and pipe shield wall 216 are all integrally molded parts of the lower portion 206 of the module 106. In a preferred embodiment, the countertop 164, perimeter wall 174, module ceiling 176, side panels 223 and 225, interior sidewalls 210 and 212, floor 214 and pipe shield panel 216 are all one integrally molded part thus providing great structural integrity to the module 106 and making it economical to manufacture and install. A night light 228 is mounted on interior sidewall 210 as seen in FIG. 6.

As best seen in FIGS. 6 and 7, the integrally molded portions of the module 106 include a perimeter flange 230 integrally molded therewith to provide an aesthetically pleasing interface and fit with the sidewall assemblies 222 adjacent thereto.

Referring again to the front elevation view of FIG. 5, on the left hand side of the concave wheelchair receiving recess 208 there is located a recessed trash receptacle 222 which is mounted flush with a front surface 224 of the module which is generally in line with the front access edge 166.

The grab rail 138 extends across the module 106 above the concave wheelchair receiving recess 208 and below the countertop 164.

On the right hand side of the wheelchair receiving recess 208 is a recessed toilet tissue dispenser 226. Alternatively the positions of trash receptacle 222 and dispenser 226 can be reversed.

Figure 8:
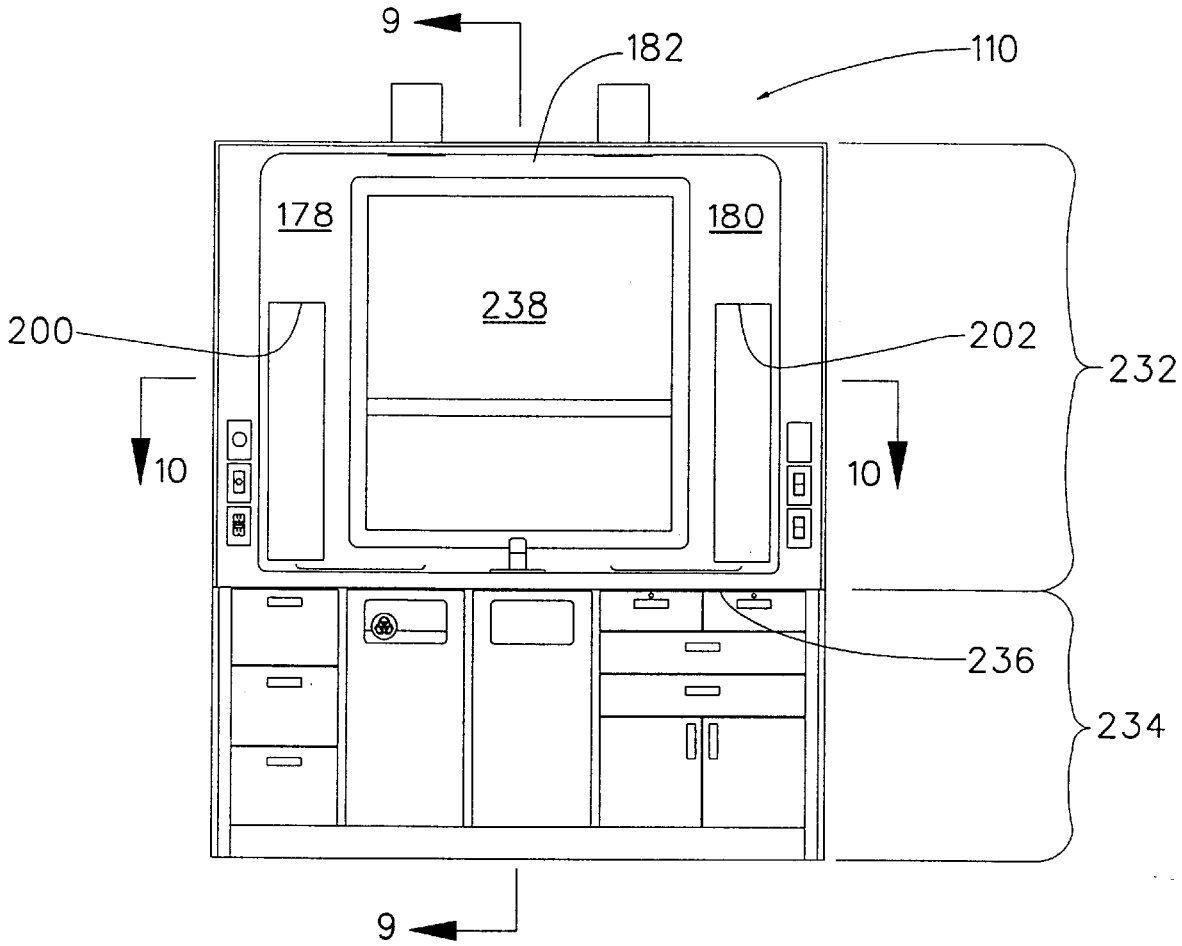
FIG. 8 is a front elevation view of the nurse's station.
Figure 9:
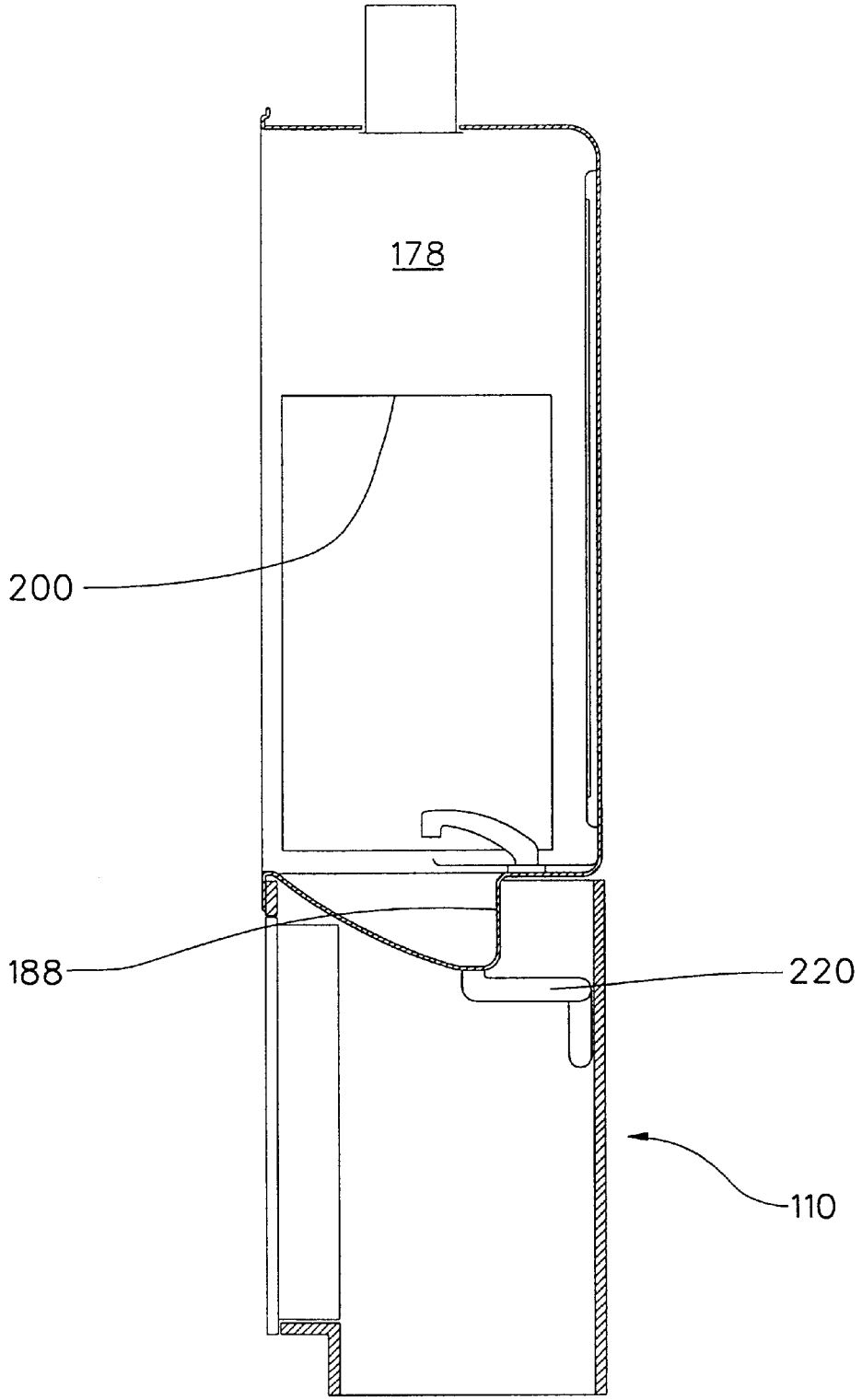
FIG. 9 is a sectioned elevation view taken along line 9—9 of FIG. 8.
Figure 10:
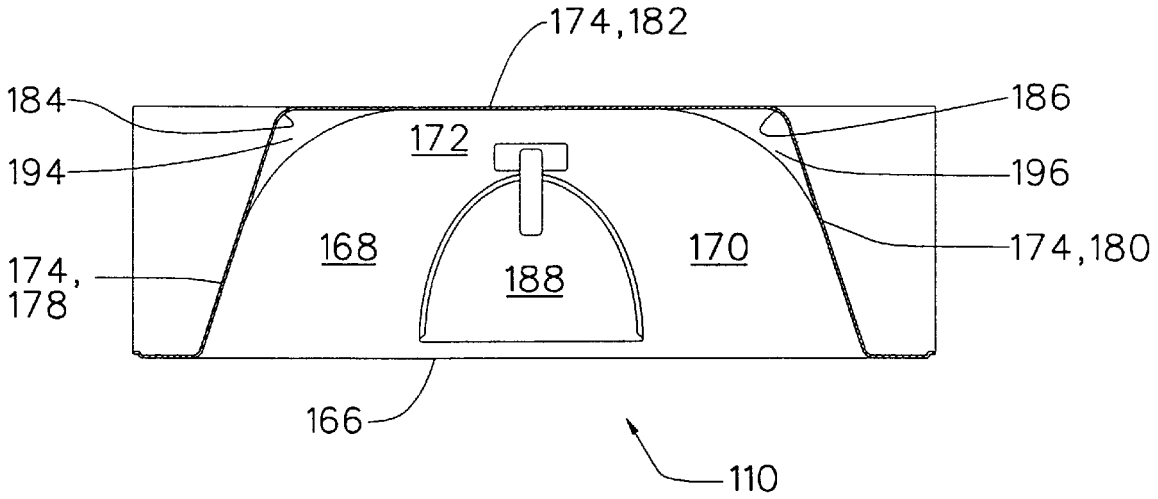
FIG. 10 is a section plan view taken along line 10—10 of FIG. 8.

Turning now to FIGS. 8, 9 and 10, the details of construction of the nurse's station 110 are shown. The nurse's station 110 includes an upper portion 232 and a lower portion 234.

The upper portion 232 of nurse's station 110 is constructed substantially identical to the upper portion 198 of the vanity unit 106, and can in fact be molded from the same mold. The molded plastic portions of the nurse's station 110, however, terminate at a lower edge 236 defining the lower end of upper portion 232.

Figure 14:
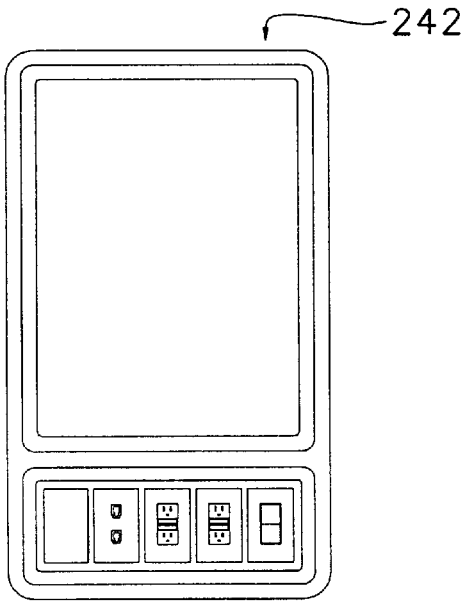
FIG. 14 is a front elevation view of a communications cabinet module.
Figure 15:
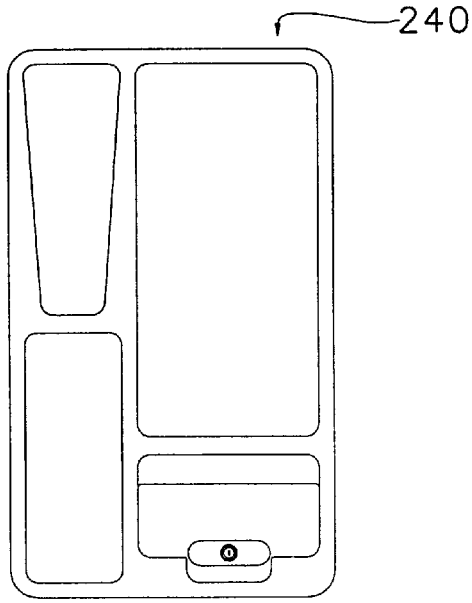
FIG. 15 is a front elevation view of a sharps cabinet module.

Typically, the only differences between the upper portion 232 of the nurse's station 110 and the upper portion 198 of the vanity unit 106 involve the separate structures mounted therein. For example, the nurse's station 110 will preferably have a sharps disposal cabinet 240 as best shown in FIG. 15, mounted in the opening 200 in the left sidewall 178, and will have a communications module 242 as best shown in FIG. 14 mounted in the opening 202 in the right side panel 180. The positions of cabinets 240 and 242 may be reversed if desired. Also, instead of a mirror, preferably a bulletin board or marker board 238 which may be either a marker board or a tack board is mounted on the back wall 182.

The lower portion 234 of the nurse's station 110 is a pre-fabricated drawer assembly including an assortment of drawers and storage areas as seen in FIG. 8.

Figure 16:
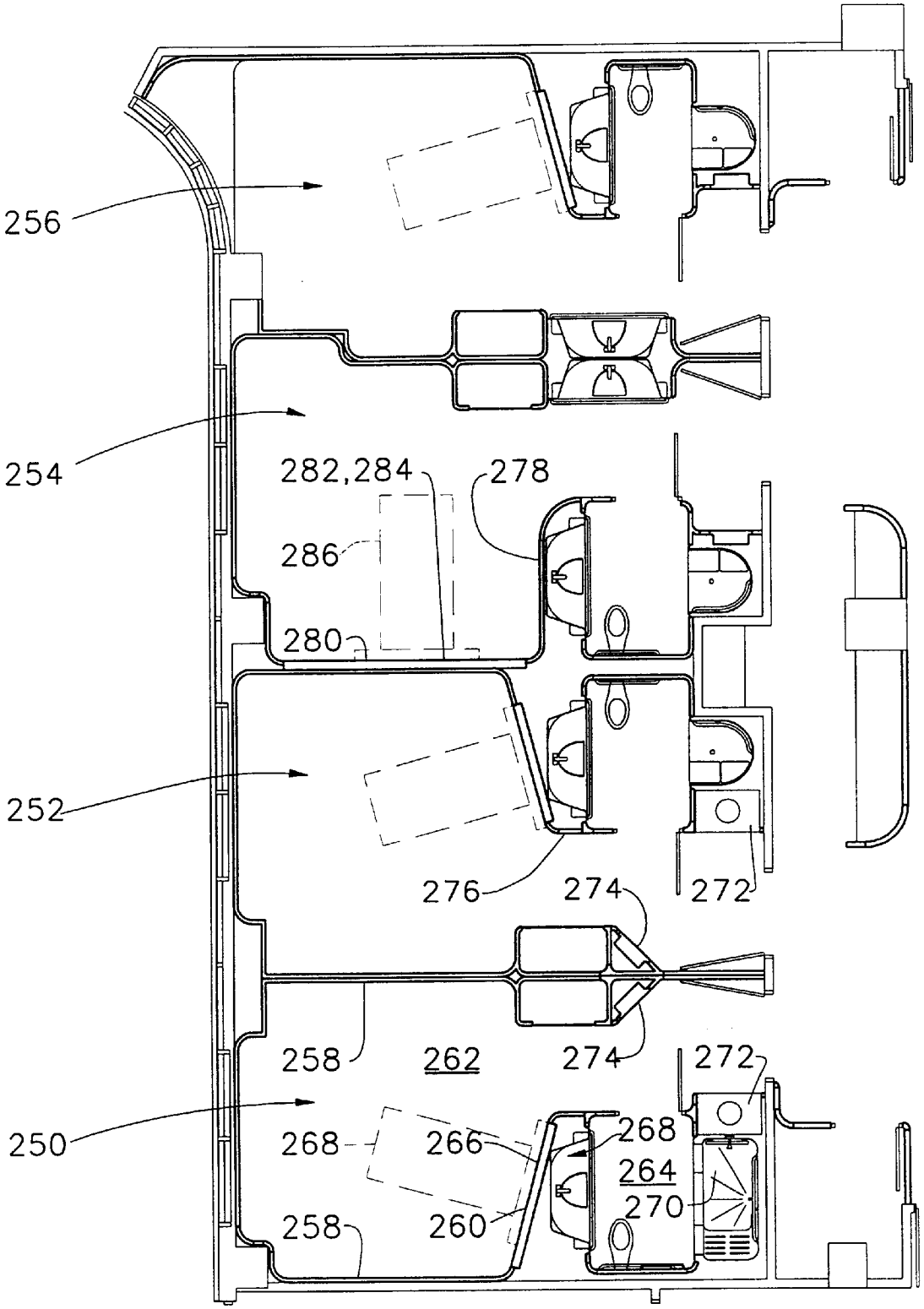
FIG. 16 is a plan view of several alternative lay-outs for room interiors.
Figure 17:
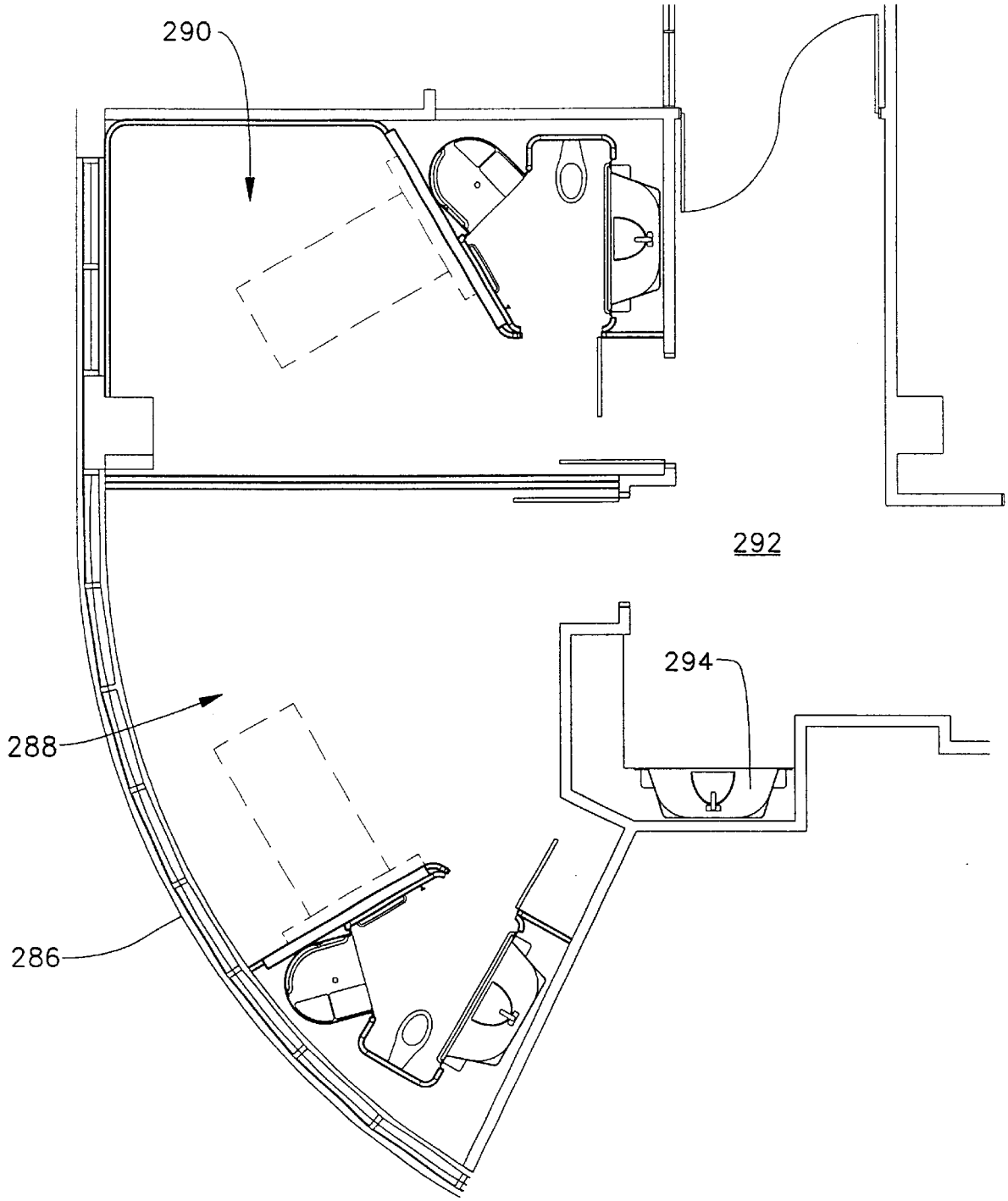
FIG. 17 is a plan view of two more alternative lay-outs for room interiors.

The Embodiments of FIGS. 16 and 17

FIGS. 16 and 17 provide some alternative layouts of room spaces which have been created utilizing the modular assembly of the present invention. In the embodiment of FIG. 16 four modular patient healthcare room interior assemblies are shown and generally designated by the numerals 250, 252, 254 and 256, respectively.

The room interior assemblies 250, 252, and 256 are similarly constructed. For example, room interior assembly 252 includes a sidewall 258, and a divider wall 260 dividing the space into a bedroom 262 and a bathroom 264. A medical gas rail assembly 266 is mounted on the divider wall 260, and the location of the bed 268 is shown in dashed lines. These rooms each include a vanity 268 and bathing unit 270 similar to those previously described.

One change as compared to the layouts previously described is with regard to the nurse's station 272, which no longer carries the sharps cabinet and data communications module as integral parts thereof. In the unit 250 of FIG. 16, a separate data communications panel 274 is provided. A separate sharps storage unit 276 may be located at any convenient location within the bedroom.

Another alternative arrangement is seen for the room interior assembly 254 of FIG. 16. In this embodiment, a divider wall 278 is oriented at a generally ninety degree angle to the sidewall 280. In this instance the sidewall 280 includes a headwall panel 282 upon which is mounted a medical gas rail assembly 284. The location of the bed 286 adjacent the headwall 282 is shown in dashed lines.

FIG. 17 shows still other room layouts which may utilize certain portions of the present invention. The room layouts of FIG. 16 are associated with a curved outer wall 286 thus dictating different interior layouts for the room spaces. In FIG. 17 two room spaces designated as 288 and 290 are shown.

One primary difference in the layout of FIG. 17 is that the two rooms 288 and 290 share a common staff foyer space 292 in which a nurse's station 294 is located for common use by the staff attending to patients in rooms 288 and 290.

Methods of Onsite Assembly

All of the wall panel segments of sidewall assembly 22, the divider wall 100, the vanity units 106 and 156, the bathing units such as 108 and 158, and the nurse's station 110 and 160 are fabricated at one or more off site locations.

Most of the segments of the sidewall assembly 22 and divider wall 100 will be standard length either straight or rounded pieces, but where necessary custom dimension components will be fabricated to fit a particular onsite room.

As will be appreciated by those skilled in the art, the space of the building 12 which is to be converted into the patient healthcare room like those previously described, may either be a completely unfinished space of a newly constructed building, or it may be a space of an existing building which is being renovated.

Typically, the installation of the sidewall assembly 22, divider wall 100, vanity units such as 106 or 156, bathing unit such as 108 or 158, and nurse's station such as 110 or 160 will be part of a turnkey package which will include finishing of the floor and ceiling of the building space and installation of all necessary plumbing and electrical wiring.

A typical such turnkey package will be constructed as follows.

First, prior to locating the pre-fabricated components, the floor and ceiling of the space will be finished. The floor will typically be covered with floor coverings such as carpet or sheet vinyl. The ceiling will typically be constructed of a conventional drop ceiling type structure or of a painted gypsum board type structure.

After the finishing of the floor and ceiling, the bathing unit, vanity unit, nurse's station, toilet and any other structures requiring plumbing will typically be located and connected to existing plumbing stubs.

Next, the headwall panel 82 of divider wall 100 will be installed and connected to all necessary plumbing and electrical connections.

Then the ceiling and floor tracks for holding the wall panel segments of sidewall assembly 22 will be laid in place, and then the various panels of the sidewall panel assembly 22 will be installed.

Then the electrical wiring will be pulled through the walls and ceiling to the various electrical outlets and fixtures.

Then lighting fixtures and other electrical equipment can be installed.

Finally, the bed and other furniture will be placed within the room.

By this method, the majority of the on-site skilled craft work such as carpentry, painting, plumbing, and electrical which has previously been required in conventional construction is eliminated. Most of this work is now done in a controlled factory environment as part of the manufacture of the various pre-fabricated components. On-site construction time is greatly reduced.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed:

1. A pre-fabricated module, comprising:

a counter-top having a front edge, side portions and a rear portion;

a sink disposed in the counter-top;

a perimeter wall extending upward from the side and rear portions of the counter-top, the perimeter wall including two planar sidewall portions and a planar back wall portion, the sidewall portions being slanted toward each other in plan view so that the sidewall portions are closer together adjacent the back wall portion than they are adjacent the front access edge, the sidewall portions and the back wall portions intersecting to form two obtuse corners, wherein each of the two planar sidewall portions of the perimeter wall have substantially identical cabinet receiving openings defined therethrough;

wherein the counter-top, the sink, and the perimeter wall are formed as a one piece integrally molded structure; and first and second cabinets mounted in the cabinet receiving openings.

2. The module of claim 1, being a vanity station, wherein:

the first cabinet is a storage cabinet and the second cabinet is a towel and soap dispensing cabinet.

3. The module of claim 1, further comprising:

a mirror mounted on the back wall portion of the perimeter wall.

4. The module of claim 1, being a nurse's station, wherein:

the first cabinet is a communication cabinet and the second cabinet is a sharps disposal cabinet.

5. The module of claim 4, further comprising:

a bulletin board mounted on the back wall portion of the perimeter wall.

6. A vanity station, comprising:

a counter-top having a front access edge, side portions and a rear portion;

a sink disposed in the counter-top;

a perimeter wall extending upward from the side and rear portions of the counter-top, the perimeter wall including two planar sidewall portions and a planar back wall portion, the sidewall portions being slanted toward each other in plan view so that the side wall portions are closer together adjacent the back wall portion than they are adjacent the front access edge, the sidewall portions and the back wall portions intersecting to form two obtuse corners;

wherein the counter-top has an arcuate enclosed edge bounded by and tangential to the sidewall portions and back wall portions of the perimeter wall;

integral shelves formed in the obtuse corners of the perimeter wall, the integral shelves lying outside the arcuate enclosed edge and above the elevation of the counter-top;

wherein the counter-top, the sink, the perimeter wall, and the integral shelves are formed as a one piece integrally molded structure.

7. The vanity station of claim 6, wherein:

the one piece integrally molded structure includes a flange on a forward edge of the sidewall portions, the flange being constructed to fit with a complementary shaped pre-fabricated room wall.

8. A pre-fabricated module comprising:

a counter-top having a front access edge, side portions and a rear portion;

a sink disposed in the counter-top;

a perimeter wall extending upward from the side and rear portions of the counter-top, the perimeter wall including two planar sidewall portions and a planar back wall portion, the sidewall portions being slanted toward each other in plan view so that the sidewall portions are closer together adjacent the back wall portion than they are adjacent the front access edge, the sidewall portions and the back wall portions intersecting to form two obtuse corners;

a ceiling spanning the perimeter wall above the counter-top;

wherein the front access edge of the counter-top is straight, and in plan view, the front access edge and the perimeter wall form a generally trapezoidal shape; and wherein the counter-top, the sink, the perimeter wall, and the ceiling are formed as a one piece integrally molded structure.

9. The pre-fabricated module of claim 8, wherein:

the one piece integrally molded structure includes a flange on a forward edge of the sidewall portions, the flange being constructed to fit with a complimentary shaped pre-fabricated room wall.

* * * * *

UNITED STATES PATENT AND TRADEMARK OFFICE

CERTIFICATE OF CORRECTION

PATENT NO. : 6,256,936 B1
DATED : July 10, 2001
INVENTOR(S) : Swensson et al.

It is certified that error appears in the above-identified patent and that said Letters Patent is hereby corrected as shown below:

Column 9, claim 1,
Line 33, before "edge" insert -- access --.

Column 9, claim 3,
Line 56, delete "1" and substitute -- 2 -- therefor.

Signed and Sealed this

Twenty-sixth Day of February, 2002

*Attest:*

*Attesting Officer*

JAMES E. ROGAN
*Director of the United States Patent and Trademark Office*